US008936352B2

(12) United States Patent
Na et al.

(10) Patent No.: US 8,936,352 B2
(45) Date of Patent: Jan. 20, 2015

(54) PRINTER INCLUDING PRINTER NOZZLE

(71) Applicants: Ye-Seul Na, Yongin (KR); Kyoung-Wook Min, Yongin (KR)

(72) Inventors: Ye-Seul Na, Yongin (KR); Kyoung-Wook Min, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 0 days.

(21) Appl. No.: 13/921,350

(22) Filed: Jun. 19, 2013

(65) Prior Publication Data

US 2014/0158795 A1 Jun. 12, 2014

(30) Foreign Application Priority Data

Dec. 11, 2012 (KR) ..... 10-2012-0143831

(51) Int. Cl.

| | |
|---|---|
| ***B41J 2/14*** | (2006.01) |
| ***B41J 2/16*** | (2006.01) |
| ***B05B 1/16*** | (2006.01) |
| ***B05B 1/30*** | (2006.01) |
| ***B05B 9/04*** | (2006.01) |
| ***B05B 13/04*** | (2006.01) |
| ***B41J 2/01*** | (2006.01) |

(52) U.S. Cl.

CPC ..... *B05B 1/169* (2013.01); *B05B 1/1654* (2013.01); *B05B 1/3026* (2013.01); *B05B 9/04* (2013.01); *B05B 13/04* (2013.01); *B41J 2/01* (2013.01)

USPC ..... 347/53

(58) Field of Classification Search

None

See application file for complete search history.

(56) References Cited

U.S. PATENT DOCUMENTS 7,802,870 B2 * 9/2010 Gipson ..... 347/53

FOREIGN PATENT DOCUMENTS

| | | | |
|---|---|---|---|
| JP | 2007-062383 | A | 3/2007 |
| KR | 10-2010-0079351 | A | 7/2010 |
| KR | 10-2011-0078826 | A | 7/2011 |

* cited by examiner

*Primary Examiner* — Lisa M Solomon

(74) *Attorney, Agent, or Firm* — Lee & Morse, P.C.

(57) ABSTRACT

A printer includes a nozzle hole plate including a plurality of nozzle holes, the nozzle hole plate being rotatable; and a nozzle part including a sleeve having a leading passage corresponding to one of the plurality of nozzle holes of the nozzle hole plate.

17 Claims, 4 Drawing Sheets

PRINTER INCLUDING PRINTER NOZZLE

CROSS-REFERENCE TO RELATED APPLICATION

This application claims priority to and the benefit of Korean Patent Application No. 10-2012-0143831, filed on Dec. 11, 2012, in the Korean Intellectual Property Office, and entitled: "PRINTER INCLUDING PRINTER NOZZLE," which is incorporated by reference herein in its entirety.

BACKGROUND

1. Field

Embodiments relate to a printer including a printer nozzle.

2. Description of the Related Art

Generally, when developing a high-performance nano-scale electronic device, etc., a patterned organic matter layer, etc. may frequently need to be formed as a fixed body. A printer may be used for forming the patterned organic matter layer of such a fixed body.

SUMMARY

Embodiments are directed to a printer, including a nozzle hole plate including a plurality of nozzle holes, the nozzle hole plate being rotatable, and a nozzle part including a sleeve having a leading passage corresponding to one of the plurality of nozzle holes of the nozzle hole plate.

The sleeve may include an electromagnet, and the nozzle hole plate may be configured to be coupled with the sleeve by a magnetic force.

The sleeve itself may be an electromagnet.

The sleeve may include the electromagnet at a position proximate to the nozzle hole plate.

The printer may further include a nozzle housing for accommodating the sleeve, wherein an end of the nozzle housing that is oriented in a direction of the nozzle hole plate is open.

The sleeve may be movable relative to the nozzle housing in a reciprocal direction such that the sleeve moves toward and away from the nozzle hole plate.

The sleeve may be connected with the nozzle housing by an elastic element.

When the sleeve is coupled with the nozzle hole plate by the electromagnet included in the sleeve, the sleeve may move toward the nozzle hole plate relative to the nozzle housing, and when the sleeve is separated from the nozzle hole plate, the sleeve may move away from the nozzle hole plate relative to the nozzle housing.

When the sleeve is coupled with the nozzle hole plate by the electromagnet included in the sleeve, the nozzle hole plate may move toward the sleeve, and when the sleeve is separated from the nozzle hole plate, the nozzle hole plate may move away from the sleeve.

At least some of the plurality of nozzle holes of the nozzle hole plate may have different sizes.

A diameter of the leading passage of the sleeve may be larger than a largest diameter among diameters of the plurality of nozzle holes.

The plurality of nozzle holes of the nozzle hole plate may be the same size.

The plurality of nozzle holes of the nozzle hole plate may be formed at a same distance from a central rotation axis of the nozzle hole plate.

The printer may further include a filter unit for filtering materials injected into the leading passage of the sleeve.

The leading passage of the sleeve may include a first portion whose diameter is constant in a portion of the sleeve proximate to the nozzle hole plate.

The leading passage of the sleeve may include a second portion whose diameter is reduced toward the first portion.

BRIEF DESCRIPTION OF THE DRAWINGS

The above and other features and advantages will become more apparent by describing in detail example embodiments thereof with reference to the attached drawings in which.

DETAILED DESCRIPTION

Figure 1:
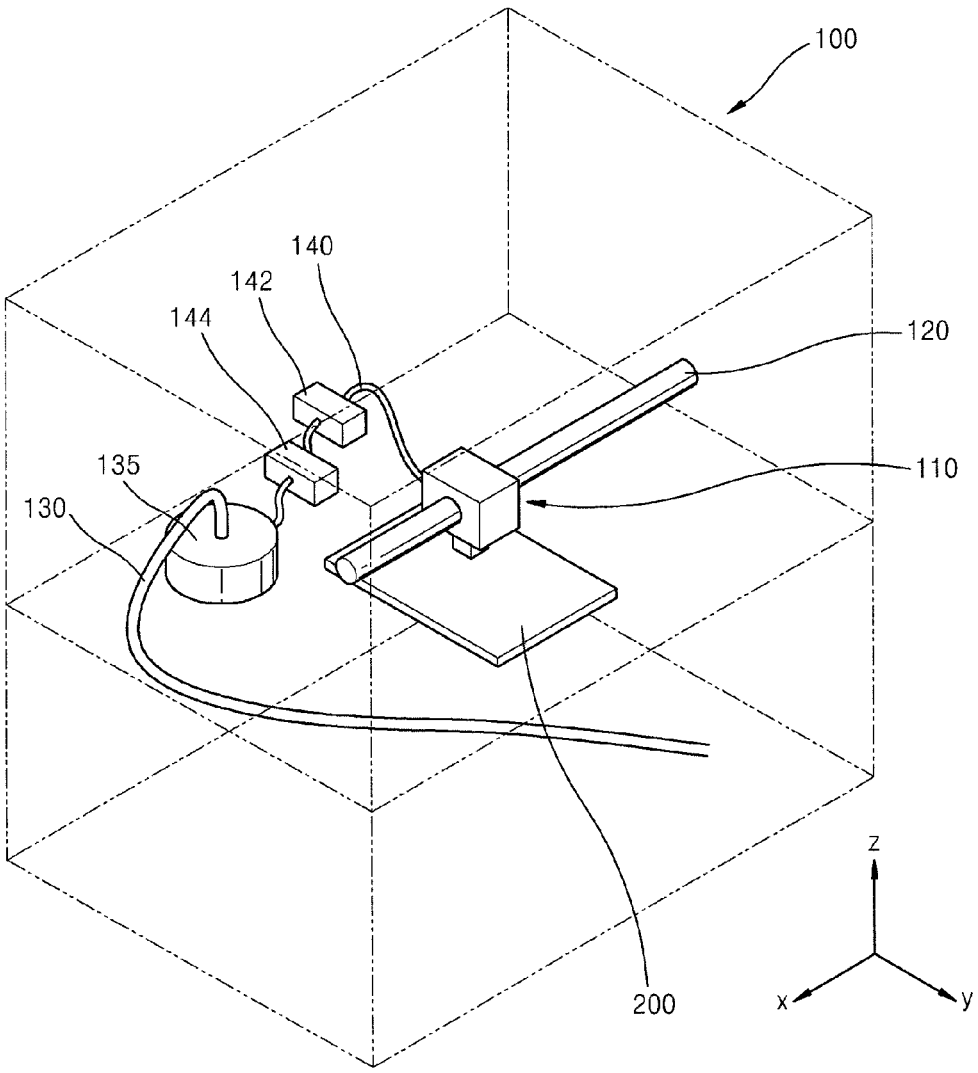
FIG. 1 is a conceptual diagram schematically illustrating a printer including a printer nozzle according to an example embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. Like reference numerals refer to like elements throughout.

In the embodiments described below, an x-axis, y-axis, and z-axis are not limited to three axes on rectangular coordinates, but may be understood in a larger sense as a space including the three axes. For example, the x-axis, y-axis, and z-axis may be perpendicular to each other, but may not be perpendicular to each other.

As used herein, the term "and/or" includes any and all combinations of one or more of the associated listed items. Expressions such as "at least one of," when preceding a list of elements, modify the entire list of elements and do not modify the individual elements of the list.

Figure 2:
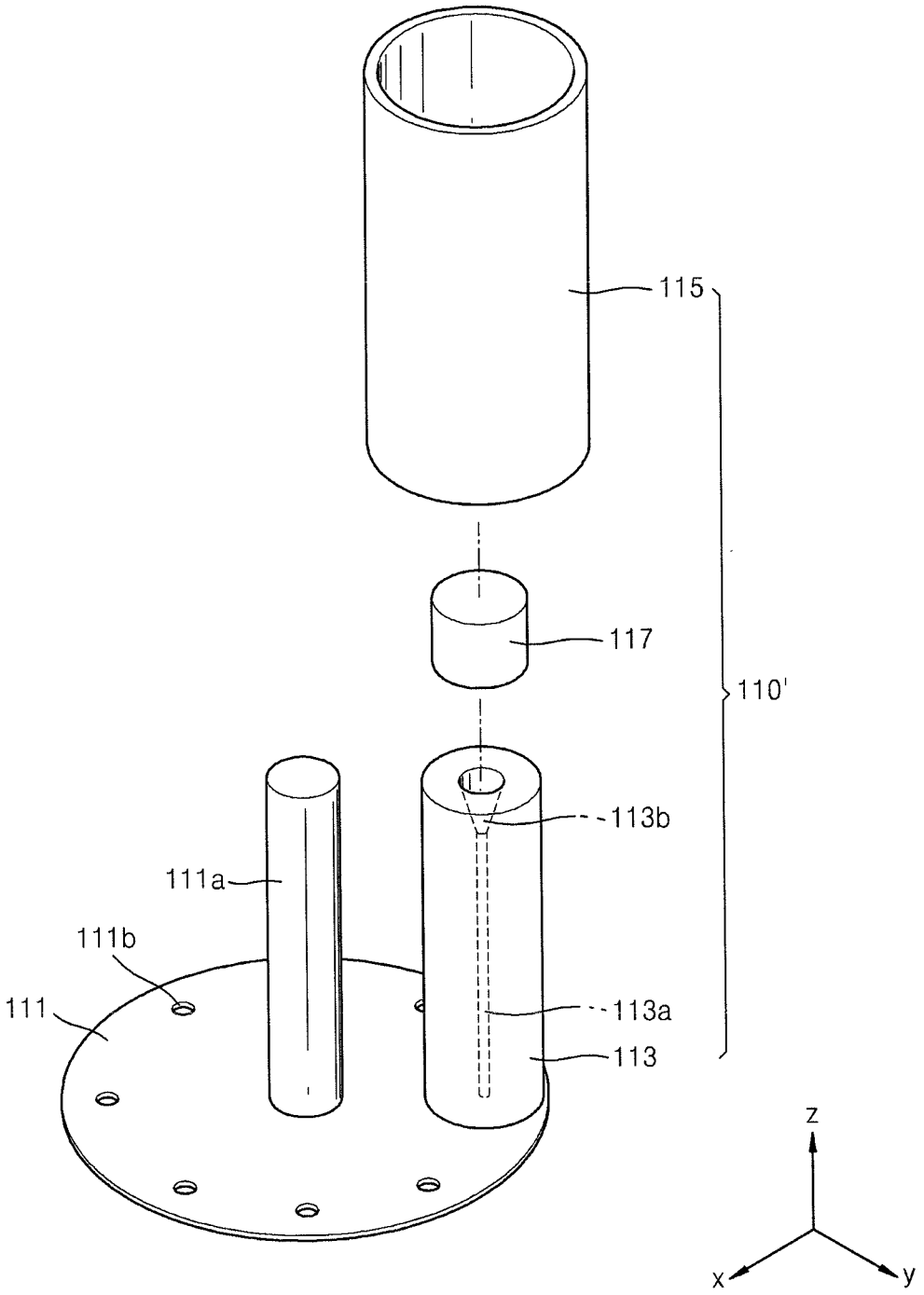
FIG. 2 is a conceptual diagram schematically illustrating a nozzle unit of FIG. 1.

FIG. 1 is a conceptual diagram schematically illustrating a printer 100 including a printer nozzle according to an example embodiment, and FIG. 2 is a conceptual diagram schematically illustrating a nozzle unit of FIG. 1.

The printer 100 according to an example embodiment may include a head unit 110, a guide unit 120 for guiding the head unit 110 to be moved in one direction (+x direction or −x direction), a solution supply line 140, which is connected to the head unit 110, for supplying a solution that is to be discharged, to the head unit 110, a solution storage unit 135 for storing a solution to be supplied to the head unit 110 through the solution supply line 140, and an air supply line 130 for supplying air, which is used to apply pressure within the solution storage unit 135, to the solution storage unit 135 to move the solution within the solution storage unit 135 to the solution supply line 130. The components described above are may be used alone or in combination, and only some of the components may be included in the printer 100 according to an example embodiment.

Here, the solution represents materials to be discharged through the printer nozzle, for example, organic matter, which is a component of each pixel of an organic light emitting display.

Herein, the term "air" is used to refer to a suitable medium for applying pressure within the solution storage unit and may refer to gases such as nitrogen, etc. If air such as nitrogen, etc. is supplied to the solution storage unit 130 through the air supply line 130, the solution stored in the solution storage unit 130 is pushed toward the solution supply line 140 by the pressure of the air in the solution storage unit 135. This solution may be supplied to the head unit 110 through the solution supply line 140. A solution control unit 144 such as a mass flow controller (MFC) or a solution measuring unit 142 such as a mass flow meter (MFM) is installed in the solution supply line 140 so that the amount of solution supplied to the head unit 110 may be accurately controlled and measured.

As described above, the head unit 110 may be moved in one direction (+x direction or −x direction) along the guide unit 120. Here, a substrate 200, on which the solution discharged from the head unit 110 is to be positioned, may be moved in a direction (+y direction or −y direction) crossing the one direction (+x direction or −x direction) by a conveyer belt or a carrier on a rail (not shown). As such, the solution discharged from the head unit 110 may be accurately position at a predetermined position on the substrate 200.

Here, the position of the substrate 200 may be fixed, there may be an additional guide unit for moving the guide unit in the direction (+y direction or −y direction) crossing the one direction (+x direction or −x direction), and the solution discharged from the head unit 110 may be set to be accurately positioned at a preset position on the substrate 200. Likewise, various modifications of the embodiment are possible.

The head unit 110 includes a nozzle hole plate 111 and a nozzle part 110' as illustrated in FIG. 2. Here, the nozzle hole plate 111 may be referred to as a nozzle hole sheet. The nozzle hole plate 111 may be rotated about an extended rotation axis 111*a*, and a plurality of nozzle holes 111*b* may be formed on the plate on the xy-plane.

The nozzle part 110' may have a sleeve 113. Leading passages 113*a* and 113*b*, which may correspond to one of a plurality of nozzle holes 111*b* of the nozzle hole plate 111, are formed inside the sleeve 113. The leading passages 113*a* and 113*b* are routes via which the solution supplied to the head unit 110 through the solution supply line 140 may be moved, and are extended downward (−z direction) so that the solution may be moved downward (−z direction).

The diameter of the leading passages 113*a* and 113*b* of the sleeve 113 may be larger than the diameter of each nozzle hole 111*b* of the nozzle hole plate 111. As such, the preset amount may be set to be finally discharged to the outside through one of the nozzle holes 111*b* of the nozzle hole plate 111 while allowing the solution to be smoothly supplied in the direction of the nozzle hole plate 111.

If the diameter of the leading passages 113*a* and 113*b* of the sleeve 113 is much larger than the diameter of each nozzle hole 111*b* of the nozzle hole plate 111, an excessively large amount of solution may be supplied to the nozzle hole plate 111 compared to the amount which may pass through the nozzle hole 111*b* of the nozzle hole plate 111, and thus the nozzle hole plate 111 or the nozzle hole 111*b* may be damaged by the continuous pressure due to the excessive amount of solution. Thus, the leading passages 113*a* and 113*b* of the sleeve 113 may have a first part 113*a* whose diameter is constantly maintained and is a little larger than the diameter of the nozzle hole 111*b* of the nozzle hole plate 111 in the portion in the direction (−z direction) of the nozzle hole plate 111 of the sleeve 113.

Furthermore, the leading passages 113*a* and 113*b* of the sleeve 113 may have a second part 113*b* whose diameter is gradually reduced up to the first part 113*a* in a direction (+z direction) opposite to the direction of the nozzle hole plate 111 of the sleeve 113. The diameter at a certain point of the second part 113*b* is larger than the diameter of the first part 113*a*. Hence, the damage to the nozzle hole plate 111 may be prevented by reducing the pressure applied to the nozzle hole plate 111 when the solution is supplied to the nozzle hole plate 111 through the first part 113*a* by reducing the supplied pressure while temporarily retaining the solution supplied from the filter unit 117, etc. in the second part 113*b*.

The leading passages 113*a* and 113*b* are formed within the sleeve, and are extended downward (−z direction) as illustrated. If there are impurities in the solution, part of the leading passages 113*a* and 113*b* or at least part of the nozzle hole 111*b* of the nozzle hole plate 111 may be closed resulting in the printing being inappropriately performed. Thus, the filter unit 117 may be set to be located in the nozzle part 110', or at the outside (not shown), so that the materials injected to the leading passages 113*a* and 113*b* of the sleeve 113 may be filtered.

The nozzle part 110' includes a nozzle housing 115 that may accommodate the sleeve 113 and/or the filter unit 117 there inside. The nozzle housing 115 may have a cylindrical shape whose upper and/or lower parts are open. The nozzle housing 115 may allow the solution supply line 140 to be directly or indirectly connected to the filter unit 117 and/or the sleeve 113 through the upper part so that the solution may be supplied to the filter unit 117 and/or the sleeve 113. The nozzle housing 115 may allow the solution, which has passed through the leading passages 113*a* and 113*b* of the sleeve 113, to enter the nozzle hole 111*b* of the nozzle hole plate 111 through the lower part in the direction of the nozzle hole plate 111.

As described above, the nozzle part 110' includes the sleeve 113 and the nozzle housing 115, and the head unit 110 includes the nozzle part 110' and the nozzle hole plate 111. However, a combination of the nozzle part 110' and the nozzle hole plate 111 may also be referred to as a nozzle unit. Likewise, the component referred to as "nozzle" may generally be the nozzle part 110' of the printer or a nozzle unit. Consequently, such a nozzle unit may be understood as a portion where a solution is supplied from the solution storage unit 135 and the solution is discharged. The discharged solution may form a droplet at the end of the nozzle unit.

The head unit 110 may include one nozzle part 110' or nozzle unit, or a plurality of nozzle parts 110' or nozzle units. For example, a plurality of nozzle parts 110' may be arranged on one nozzle hole plate 111 formed where a plurality of nozzle hole plates 110*b* are formed so that the leading passage 113*a* and 113*b* of each of the nozzle parts 110' may correspond to each of the nozzle holes 111*b* of the nozzle hole plate 111.

In a general printer, a nozzle housing may itself have a bending part where internal diameter of the nozzle housing decreases, the sleeve in the nozzle housing may contact or be in close contact with the bending part of the nozzle housing, and a plate nozzle (or a sheet nozzle) where a single nozzle hole is formed may be positioned at the end in the direction of the bending part of the nozzle housing of the sleeve. That is, the plate nozzle may be interposed between the end in the direction of the bending part of the nozzle housing of the sleeve and the bending part of the nozzle housing. In the case of using such a general printer, when the nozzle housing, the sleeve, and the plate nozzle are disassembled to wash the nozzle unit, and are then reassembled, the reassembly may be difficult. That is, in the process of positioning the plate nozzle on the sleeve and covering the sleeve and the plate nozzle with the nozzle housing, cleaning fluids used in the washing process or a solvent used in the nozzle printing process before the washing process may still remain in the bending part, etc. of the nozzle housing, and the plate nozzle having a thickness of between about 50 um and about 100 um may be separated from the sleeve due to interaction with the cleaning fluids or the solvent and may be attached on the inside of the nozzle housing or may not be positioned in an accurate predetermined location on the sleeve.

However, the printer according to the present embodiment does not use a general plate nozzle, but uses the nozzle hole plate 111. In particular, the nozzle hole plate 111 is not accommodated in the nozzle housing, but is positioned outside the nozzle housing 115, and thus when the sleeve 113, etc., are assembled to be positioned inside the nozzle housing 115, the plate nozzle may always be positioned in the original location.

Furthermore, in the case of the general printer, if foreign particles, etc., get stuck in the nozzle hole of the plate nozzle, the nozzle unit should be separated and the plate nozzle should be exchanged, which is an inconvenient process. However, in the case of the printer according to the present embodiment, the nozzle hole plate 111 is positioned outside the nozzle part 110', and thus even if there is a problem in the nozzle hole plate 111, the nozzle part 110' does not need to be separated.

As described above, the nozzle hole plate 111 may be rotated about the rotation axis 111*a* extended in the z-axis direction, and a plurality of nozzle holes 111*b* are formed on the xy-plane. Thus, when one nozzle hole 111*b* of the nozzle hole plate 111 is partly closed or damaged, the problem may be easily resolved by making another nozzle hole 111*b* correspond to the leading passage 113*a* and 113*b* of the sleeve 113.

In this case, the plurality of nozzle holes 111*b* of the nozzle hole plate 111 may have the same size. Furthermore, when rotating the nozzle hole plate 111 in a state in which the one nozzle hole 111*b* corresponds to the leading passage 113*a* and 113*b* of the sleeve 113, in order to make the other nozzle hole 111*b* correspond to the leading passage 113*a* and 113*b* of the sleeve 113, the plurality of nozzle holes 111*b* of the nozzle hole plate 111 may be set to be formed in positions that are the same distance from the central axis of rotation of the nozzle hole plate 111.

Figure 3:
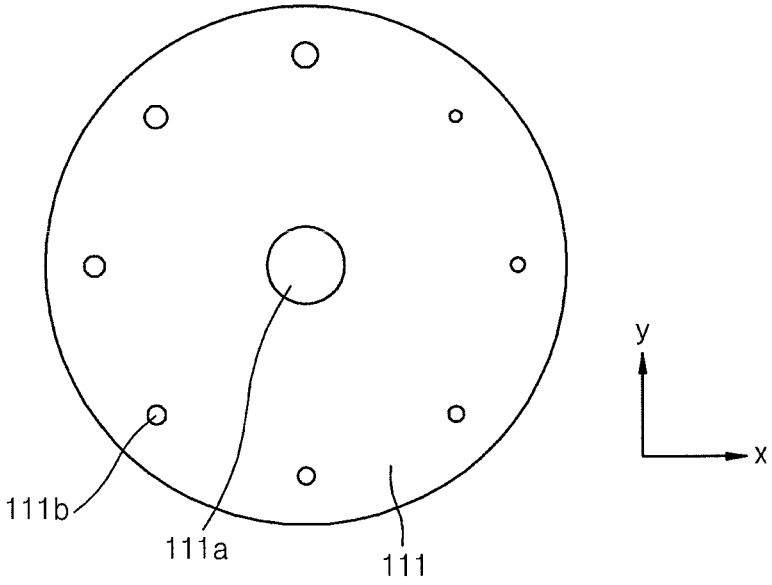
FIG. 3 is a diagram schematically illustrating a nozzle hole plate provided in a printer according to another example embodiment.

FIG. 3 is a diagram schematically illustrating a nozzle hole plate 111 provided in a printer according to another example embodiment. In the case of the printer according to the present embodiment, at least some of the plurality of nozzle holes 111*b* of the nozzle hole plate 111 may have different sizes. That is, the diameters of at least some of the plurality of nozzle holes 111*b* may be different from each other. FIG. 3 illustrates that the diameter of each nozzle hole 111*b* gets larger in a clockwise direction from the upper-right side.

In the case of a general printer, in order to change the amount of finally discharged solution, a plate nozzle having only one nozzle hole and interposed between the sleeve and the nozzle housing should be substituted by a plate nozzle having a nozzle hole having another size, and thus the nozzle housing, the sleeve and the plate nozzle should be separated.

However, in the case of the printer according to the present embodiment, at least some of the plurality of nozzle holes 111*b* of the nozzle hole plate 111 have different sizes. Thus, the nozzle holes 111*b* having different sizes may be set to correspond to the leading passage 113*a* and 113*b* of the sleeve 113 by rotating the nozzle hole plate 111 about the rotation axis 111*a* without having to disassemble the nozzle housing 115 or the sleeve 113.

In this case, the diameter of the leading passage 113*a* and 113*b* of the sleeve 113 may be set to be larger than the largest diameter among diameters of a plurality of nozzle holes 111*b*. As such, a preset amount may be controlled to be finally discharged to the outside through the nozzle hole 111*b* of the nozzle hole plate 111 while allowing the solution to be smoothly supplied in the direction of the nozzle hole plate 111 regardless of the diameter of the nozzle hole 111*b* of the nozzle hole plate 111 corresponding to the leading passage 113*a* and 113*b* of the sleeve 113.

In an implementation, the sleeve 113 may include an electromagnet. In this case, the nozzle hole plate 111 may be configured to be coupled with the sleeve 113 by a magnetic force. The nozzle hole plate 111 may include a ferromagnetic material, e.g., a ferromagnetic steel, etc. In an implementation, the nozzle hole plate 111 may include, for example, nickel.

When ink is discharged to the outside through the nozzle hole 111*b* of the nozzle hole plate 111, if the sleeve is not coupled with the nozzle hole plate 111, the ink may flow into the interface between the sleeve 113 and the nozzle hole plate 111, which may deteriorate the printing quality. Thus, the sleeve 113 may include an electromagnet, and the nozzle hole plate 111 may be set to be in close contact with the sleeve 113 by a magnetic force so that ink may be effectively prevented from flowing or leaking into an interface between the sleeve 113 and the nozzle hole plate 111 when performing the printing work.

As described above, the sleeve 113 may include an electromagnet. Thus, when the nozzle hole plate 111 is exchanged or the nozzle hole plate 111 is rotated, the magnetic force may be controlled so as not to be applied to the nozzle hole plate 111 so that the nozzle hole plate 111 may be easily separated from the sleeve 113.

In an implementation, when the sleeve 113 includes an electromagnet, the sleeve 113 itself may be an electromagnet or an electromagnet may be set to be positioned at a certain part of the sleeve 113. In the latter case, the electromagnet may be positioned in a portion (in the −z direction) of the sleeve, which is directed toward the nozzle hole plate 111, for example, the end of the sleeve, so that, when the electromagnet generates a magnetic field, the nozzle hole plate 111 may be in close contact with the end of the sleeve 113.

Figure 4:
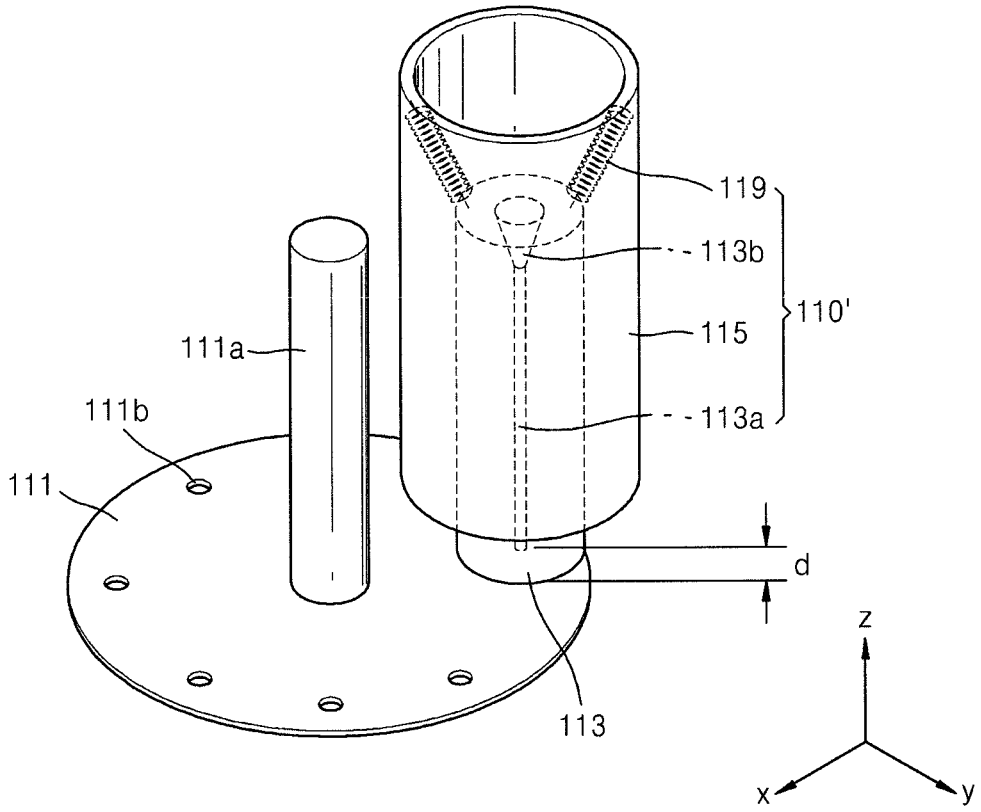
FIG. 4 is a conceptual diagram schematically illustrating a nozzle unit of a printer according to another example embodiment.

FIG. 4 is a conceptual diagram schematically illustrating a nozzle unit of a printer according to another example embodiment. In the case of the printer according to the present embodiment, the relative positions of the sleeve 113 and the nozzle housing 115 of the nozzle part 110' may vary. That is, the sleeve 113 of the printer according to the present embodiment may be moved in a direction of the nozzle hole plate 111 (−z direction) or in the opposite direction (+z direction).

As described above, the correspondence of some of the plurality of nozzle holes 111*b* of the nozzle hole plate 1111 to the leading passage 113*a* and 113*b* of the sleeve 113 may be changed by rotating the nozzle hole plate 111 about the rotation axis 111*a*, but if the nozzle hole plate 111 is in close contact with the sleeve 113, the nozzle hole plate 111 may be damaged during the rotation of the nozzle hole plate 111.

Thus, when rotating the nozzle hole plate 111 about the rotation axis 111*a*, the sleeve 113 may be set to be slightly moved in a direction (the +z direction) opposite to the direction of the nozzle hole plate 111 (the −z direction) relative to the nozzle housing 115 so that there may be a distance d between the nozzle hole plate 111 and the sleeve, thereby allowing a space to be formed therebetween. When performing a printing operation or when the nozzle hole plate 111 does not move, the sleeve 113 may be set to be positioned so that the nozzle hole plate 111 is in close contact with the sleeve 113 by moving the sleeve 113 in the direction of the nozzle hole plate 111 (the −z direction) relative to the nozzle housing 115.

Likewise, various configurations may be used to make the sleeve 113 movable in the direction of the nozzle hole plate 111 (the −z direction) or the opposite direction (+z direction) relative to the nozzle housing 115. For example, the sleeve 113 may be configured to be connected to the nozzle housing 115 by an elastic element 119. As illustrated in FIG. 4, the elastic element 119 is a spring, but the present embodiment is not limited thereto. The elastic element 119 may be a suitable elastic object such a rubber band or elastic bellows.

As described above, the sleeve may include an electromagnet, and the nozzle hole plate 111 may be configured to be coupled with the sleeve 113 by a magnetic force. In this case, if a magnetic force is not generated as the electromagnet of the sleeve 113 is turned off, the sleeve 113 may be set to be moved in a direction (the +z direction) that is opposite to the direction of the nozzle hole plate 111 (the −z direction) by the elastic element 119 so that there may be a distance d between the sleeve 113 and the nozzle hole plate 111. If the magnetic force is generated as the electromagnet of the sleeve 113 is turned on, the sleeve 113 may be moved in the direction of the nozzle hole plate 111 (the −z direction) relative to the nozzle housing 115 so that the nozzle hole plate may be coupled with the sleeve 113. That is, the sleeve 113 may be coupled with the nozzle hole plate 111 by the electromagnet included in the sleeve 113, the sleeve 113 may move in the nozzle hole plate 111 direction (−z direction) for the nozzle housing 115, and when the sleeve 113 is separated from the nozzle hole plate 111, the sleeve may move in a direction (+z direction) opposite to the direction of the nozzle hole plate 111 relative to the nozzle housing 115.

Likewise, the relative position between the sleeve 113 and the nozzle housing 115 may be determined by the magnetic force of the electromagnet included in the sleeve 113, or may be determined by a variable mechanical position component.

As described above, the relative positions of the sleeve 113 and the nozzle housing 115 of the nozzle part 110' are variable, that is, the sleeve 113 may be moved in the direction of the nozzle hole plate 111 (the −z direction) or in the opposite direction (the +z direction) within the nozzle housing 115, but the present embodiment is not limited thereto. For example, the positions of the sleeve 113 and the nozzle housing 115 of the nozzle part 110' may be fixed, and the nozzle hole plate 111 may be moved in the direction of the nozzle part 110' (the +z direction) or in the opposite direction (the −z direction).

As described above, the sleeve 113 may include an electromagnet, and the nozzle hole plate 111 may be configured to be coupled with the sleeve 113 by a magnetic force. In this case, if the magnetic force is not generated due to the electromagnet of the sleeve 113 being turned off, the nozzle hole plate 111 may move in a direction (the −z direction) opposite to the direction of the nozzle part 110' so that there may be a distance between the nozzle part 110' and the nozzle hole plate 111. If the magnetic force is generated due to the electromagnet of the sleeve being turned on, the nozzle hole plate 111 may move in the direction of the nozzle part 110' (the +z direction) due to the magnetic force so that the nozzle hole plate 111 may be closely coupled with the sleeve 113.

Thus, when the sleeve 113 is coupled with the nozzle hole plate 111 by the electromagnet included in the sleeve 113, the nozzle hole plate 111 may move in the direction of the nozzle part 110' (the +z direction, i.e., in the direction of the sleeve 113), and when the sleeve 113 is separated from the nozzle hole plate 111, the nozzle hole plate 111 may move in a direction (the −z direction) opposite to the direction of the nozzle part 110' relative to the nozzle part 110'. To this end, the nozzle hole plate 111 may be set to move relative to a frame, housing, etc., (not shown) due to an elastic element being coupled with the nozzle hole plate 111 or the rotation axis 111*a*.

By way of summation and review, a printer having a printer nozzle may be used for forming a patterned organic matter layer of a fixed body. In a general printer, a nozzle unit that regulates the amount of finally discharged organic matter may not be easily washed. Furthermore, in a process of exchanging and reassembling components in charge of regulating the amount of finally discharged organic matter in the nozzle unit or washing and reassembling the nozzle unit, the nozzle unit may not appropriately operate if each component is not correctly assembled.

As described above, embodiments may provide a printer including an easily-washed printer nozzle in which a discharged amount may be easily adjusted.

While the present invention has been particularly shown and described with reference to example embodiments thereof, it will be understood by those of ordinary skill in the art that various changes in form and details may be made therein without departing from the spirit and scope of the present invention as defined by the following claims.

What is claimed is:

1. A printer, comprising:

a nozzle hole plate including a plurality of nozzle holes in a planar surface of the nozzle hole plate, the nozzle hole plate being rotatable; and a nozzle part including a sleeve having a leading passage corresponding to one of the plurality of nozzle holes of the nozzle hole plate.

2. The printer as claimed in claim 1, wherein the sleeve includes an electromagnet, and the planar surface of the nozzle hole plate is configured to be coupled with a corresponding planar surface of the sleeve by a magnetic force.

3. The printer as claimed in claim 2, wherein the sleeve itself is an electromagnet.

4. The printer as claimed in claim 2, wherein the sleeve includes the electromagnet at a position proximate to the nozzle hole plate.

5. The printer as claimed in claim 2, further comprising a nozzle housing for accommodating the sleeve, wherein an end of the nozzle housing that is oriented in a direction of the nozzle hole plate is open.

6. The printer as claimed in claim 5, wherein the sleeve is movable relative to the nozzle housing in a reciprocal direction such that the sleeve moves towards and away from the nozzle hole plate.

7. The printer as claimed in claim 6, wherein the sleeve is connected with the nozzle housing by an elastic element.

8. The printer as claimed in claim 6, wherein, when the sleeve is coupled with the nozzle hole plate by the electromagnet included in the sleeve, the sleeve moves towards the nozzle hole plate relative to the nozzle housing, and when the sleeve is separated from the nozzle hole plate, the sleeve moves away from the nozzle hole plate relative to the nozzle housing.

9. The printer as claimed in claim 2, wherein, when the sleeve is coupled with the nozzle hole plate by the electromagnet included in the sleeve, the nozzle hole plate moves towards the sleeve, and when the sleeve is separated from the nozzle hole plate, the nozzle hole plate moves away from the sleeve.

10. The printer as claimed in claim 1, wherein at least some of the plurality of nozzle holes of the nozzle hole plate have different sizes.

11. A printer, comprising:

a nozzle hole plate including a plurality of nozzle holes, the nozzle hole plate being rotatable; and a nozzle part including a sleeve having a leading passage corresponding to one of the plurality of nozzle holes of the nozzle hole plate, wherein a diameter of the leading passage of the sleeve is larger than a largest diameter among diameters of the plurality of nozzle holes.

12. The printer as claimed in claim 1, wherein the plurality of nozzle holes of the nozzle hole plate are the same size.

13. The printer as claimed in claim 1, wherein the plurality of nozzle holes of the nozzle hole plate are formed at a same distance from a central rotation axis of the nozzle hole plate.

14. The printer as claimed in claim 1, further comprising a filter unit for filtering materials injected into the leading passage of the sleeve.

15. The printer as claimed in claim 1, wherein the leading passage of the sleeve includes a first portion whose diameter is constant in a portion of the sleeve proximate to the nozzle hole plate.

16. A printer, comprising:

a nozzle hole plate including a plurality of nozzle holes, the nozzle hole plate being rotatable; and a nozzle part including a sleeve having a leading passage corresponding to one of the plurality of nozzle holes of the nozzle hole plate, wherein:

the leading passage of the sleeve includes a first portion whose diameter is constant in a portion of the sleeve proximate to the nozzle hole plate; and the leading passage of the sleeve includes a second portion whose diameter is reduced toward the first portion.

17. The printer as claimed in claim 1, wherein the leading passage extends in a same direction as a length of the sleeve.

* * * * *